United States Patent [19]

Renecle

[11] Patent Number: 4,884,765

[45] Date of Patent: Dec. 5, 1989

[54] HIGHLY MANEUVERABLE CONTROL LINE KITE

[76] Inventor: Keith V. Renecle, 37 Beech Road, Cresslawn, Kempton Park, Transvaal, South Africa

[21] Appl. No.: 208,049

[22] Filed: Jun. 17, 1988

[30] Foreign Application Priority Data

Aug. 3, 1987 [ZA] South Africa ..... 87/5701
Feb. 4, 1988 [ZA] South Africa ..... 88/0788

[51] Int. Cl.[4] ..... B64C 31/06

[52] U.S. Cl. ..... 244/153 R; 244/154; 244/155 A

[58] Field of Search ..... 244/153 R, 154, 155 A; 446/68, 30, 61, 31; 24/17 A, 300, 324, 662

[56] References Cited

U.S. PATENT DOCUMENTS

| | | | |
|---|---|---|---|
| 642,451 | 1/1900 | Hoytet al. | 244/153 R |
| 1,696,181 | 12/1928 | Ballowe | 24/17 A |
| 2,388,478 | 11/1945 | Garber | 244/154 |
| 2,484,096 | 10/1949 | Kay | 244/153 R |
| 2,519,594 | 8/1950 | Ohland | 244/155 A |
| 3,276,730 | 10/1966 | Cleveland | 244/153 R |
| 3,416,200 | 12/1968 | Daddona, Jr. | 24/662 |
| 3,746,286 | 7/1973 | Christoffel | 244/155 A |
| 3,960,346 | 6/1976 | Cho | 244/153 R |
| 4,426,800 | 1/1984 | Brown | 244/153 R |
| 4,715,564 | 12/1987 | Kinn et al. | 244/153 R |

*Primary Examiner*—Sherman D. Basinger
*Assistant Examiner*—Anne Sartelle
*Attorney, Agent, or Firm*—Burns, Doane, Swecker & Mathis

[57] ABSTRACT

A control line kite has a flexible cover over a framework of spars including a longitudinal spar and a transverse spar. The longitudinal spar carries a weight which is adjustable along the length of the spar between the nose of the kite and the point of intersection between the spars.

18 Claims, 3 Drawing Sheets

HIGHLY MANEUVERABLE CONTROL LINE KITE

BACKGROUND OF THE INVENTION

This invention relates to a control line kite which is highly maneuverable in flight.

Control line kites are well known. Usually, they comprise a framework of rigid or semi-rigid spars across which a flexible cover is arranged to catch the wind. Instead of a single tether line, control line kites have two such lines each connected to a bridle, the bridle having connection points to the framework near to the leading and trailing ends of the kite. Typical examples of known control line kites are described in U.S. Pat. No. 1,340,047 to Dunford and U.S. Pat. No. 3,276,730 to Cleveland.

While the known control line kites have good maneuverability in flight, their flying characteristics are not easily adjustable to suit the particular preferences of different kite flyers and to suit different wind conditions.

An object of the present invention is to provide a highly maneuverable control line kite whose flying characteristics are readily adjustable.

SUMMARY OF THE INVENTION

The invention provides a control line kite which comprises a generally diamond shaped covering over a framework of spars including a longitudinal spar extending from a nose of the kite to a tail end of the kite and a transverse spar crossing the longitudinal spar at a point of intersection, a pair of control lines connected to the kite via bridles and a control handle to which the control lines are connected at spaced apart locations, wherein the longitudinal spar carries a weight whose position is adjustable between the nose of the kite and the point of intersection of the spars to vary the flying characteristics of the kite.

The kite may be tail-less, i.e. it is not necessary for it to have a stabilising, trailing tail.

Preferably the flexible covering is of a transparent material and carries a picture thereon. Most preferably, the picture is that of an aircraft seen from the side, the nose of the aircraft being towards the nose of the kite and the tail of the aircraft being towards the tail end of the kite.

Conveniently, the ends of the spars are located in pockets provided at the corners of the covering. Such pockets may be formed by folding and securing together parts of plastics members fixed to the covering at the corners thereof.

In a particularly preferred version of the invention, the control handle is relatively small, such that it can be gripped and controlled, to control the maneuvers of the kite while flying, in one hand only. The handle may also include recesses for storing the control lines in a wound-up condition when the kite is not in use. Furthermore, the control handle may have means adapted to engage the spars in clipping fashion when the kite is disassembled. Finally, the control handle may have projecting pegs about which control lines can be twisted to adjust their lengths, means being provided to prevent the twisted sections of the control lines from slipping off the pegs.

BRIEF DESCRIPTION OF THE DRAWINGS

An embodiment of the invention will now be described, by way of example only, with reference to the accompanying drawings in which.

DESCRIPTION OF THE PREFERRED EMBODIMENTS

Figure 1:
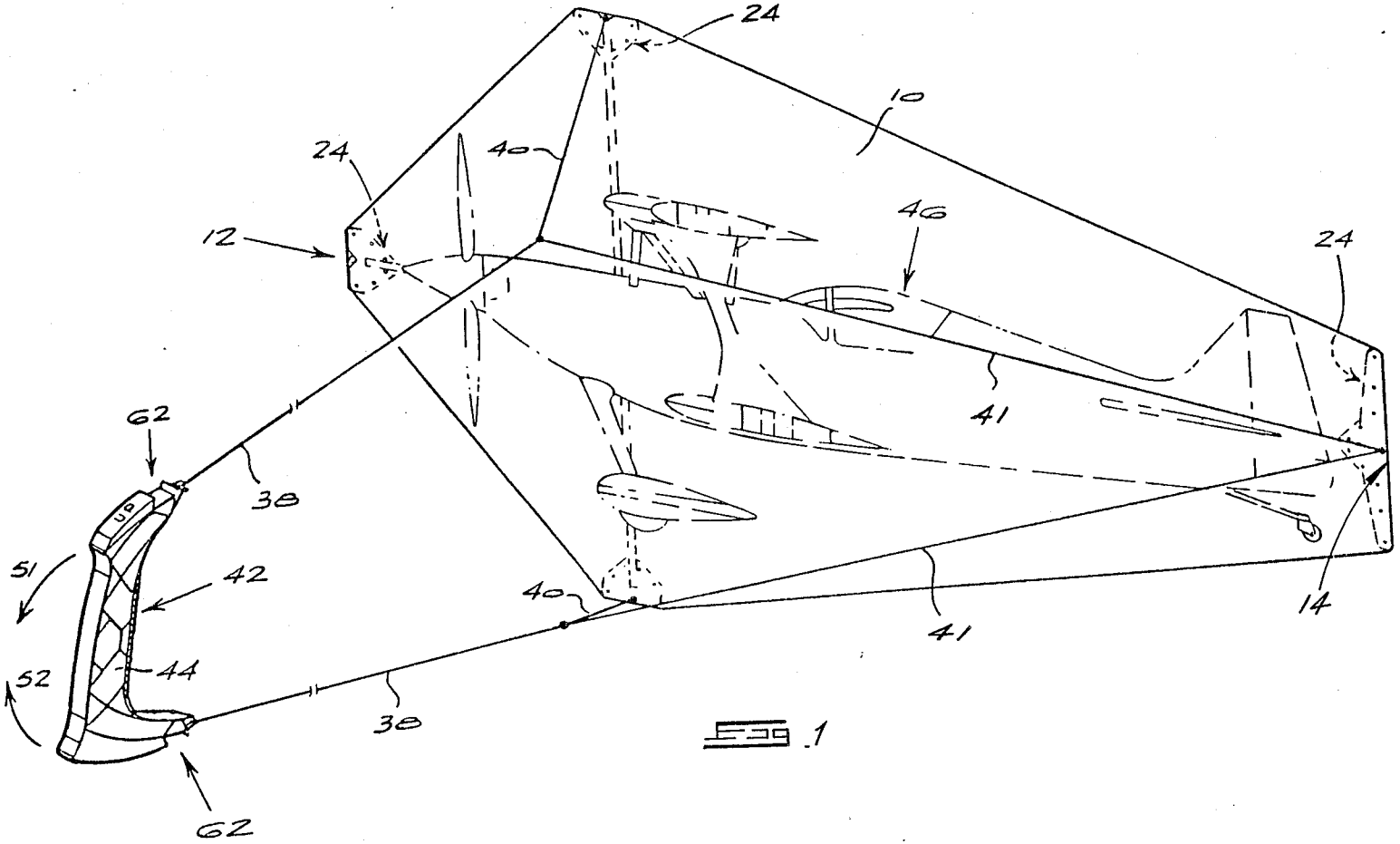
FIG. 1 shows a front perspective view of a control line kite according to the invention.

The illustrated kite has a flexible, imperforate, clear plastics covering 10 arranged over a framework of rigid or semi-rigid spars. The covering is generally diamond-shaped with a blunt nose 12 and a blunt tail end 14 which is truncated in shape. A longitudinal spar 16 of the framework (see FIG. 2) extends from the nose to the tail end and is crossed by a transverse spar 18 at a cross-over point of intersection 20.

Figure 2:
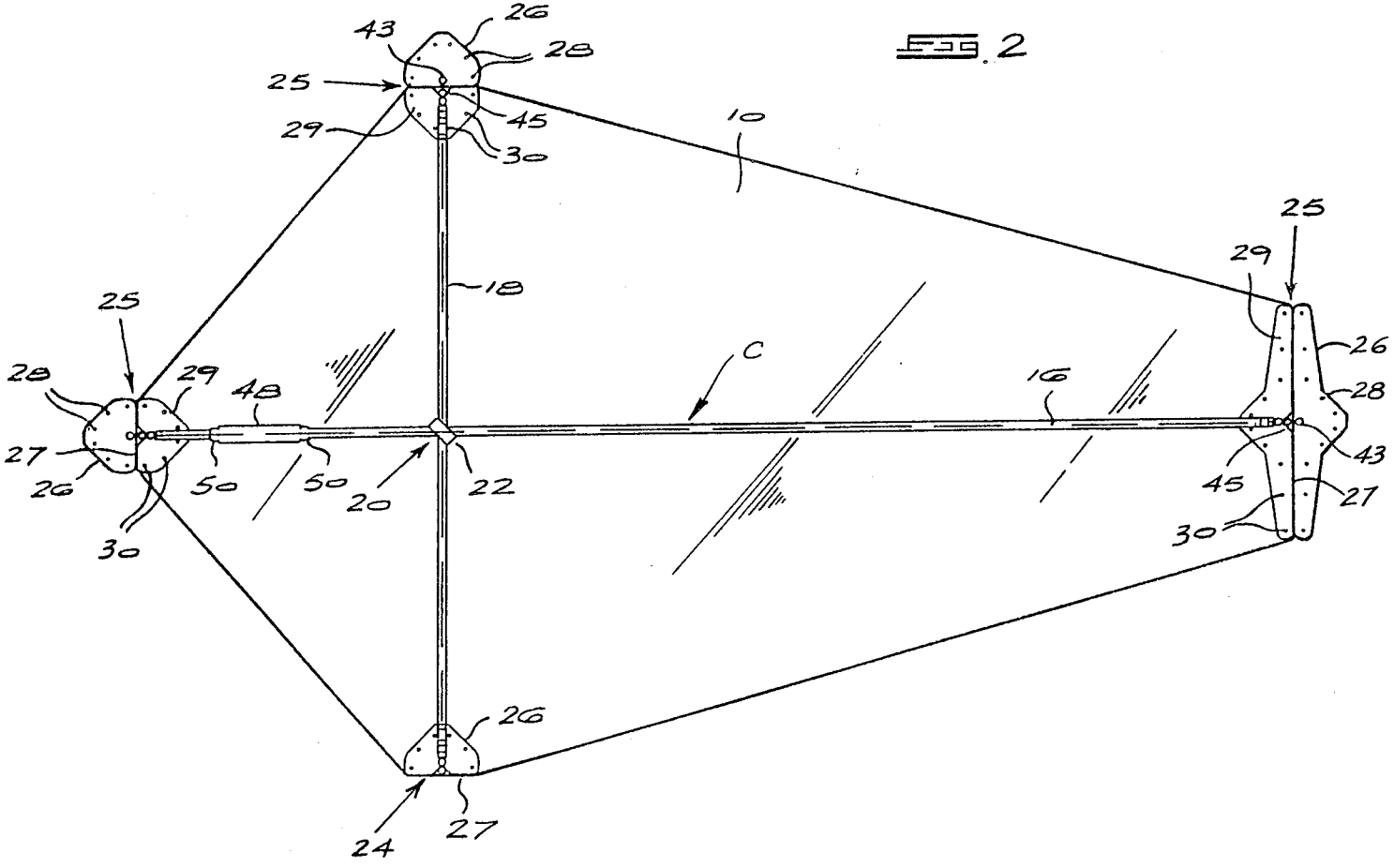
FIG. 2 shows a rear elevation of the kite during assembly, certain parts being omitted in the interests of clarity of illustration.

As shown in FIG. 2, the spars 16 and 18 are connected to one another at the point 20 by means of a flexible band 22 of rubber or the like. The flexibility of the band enables the spars 16 and 18 to pivot relative to one another about an axis which is normal to the covering 10.

The ends of the spars 16 and 18 locate in pockets 24. Each pocket 24 is formed by a plastics member 25 formed with a weakened hinge line 27 about which it is symmetrical in shape. The plastics member 25 is secured to the covering 10. One part 26 of each plastics member 25 carries elements 28 of press-stud connectors, the mating elements 30 of those connectors being carried by the other part 29 of the member 25. These features are illustrated clearly in FIG. 2 of the drawings. In order to form the relevant pocket, the part 26 is folded towards the part 29 about the hinge line 27 and the elements 28 and 30 are pressed together in the manner of conventional press-studs. FIG. 2 shows one of the pockets 24 in a closed condition and the remaining pockets open i.e. before the hinging and pressing operation.

It will be noted that the plastics members 25 are sufficiently rigid to form the blunt nose 12 and tail end 14 of the kite.

The kite is equipped with two control lines 38. Each of these control lines 38 is connected to a bridle made up of parts 40 and 41. The free end of each part 40 is connected to the kite at a side corner while the free end of each part 41 is connected to the kite at its tail end 14. The connection of the ends of the parts 40 and 41 to the side corners and tail end is facilitated by the provision of holes 43 in the parts 26 of the members 25 and holes 45 in the parts 29 of those members. When the parts 26 and 29 are folded together to form the pockets 24, the holes register and establish openings through which the ends of the parts 40 and 41 can be tied in position. For clarity of illustration, the bridles and control lines are omitted from FIG. 2.

Figure 3:
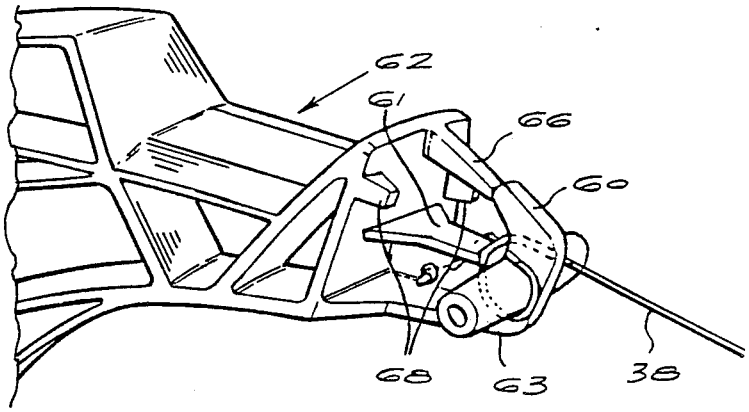
FIG. 3 shows a partial perspective view of an end of the control handle.

The opposite ends of the control lines 38 are connected to a plastics control handle 42. The control handle 42 has a grip portion 44 which can be gripped comfortably in one hand by a flyer of the kite. FIG. 1 shows that the control lines are connected to the opposite ends of the handle 42. FIG. 3 illustrates one end of the control handle and shows how the end of a control line 38 is connected to it by twisting it around a peg 60, a member 61 and a lateral bar 63. It will also be noted that the ends of the handle 42 include recesses 62. These recesses provide space for the control lines 38 to be wound up neatly when the kite is not in use. The wound up control lines are indicated with the reference numeral 64 in FIG. 4. Finally, the control handle 42 includes a resilient finger 66 and small protrusions 68 spaced to either side of the finger 66. More will be said later about the finger 66 and the protrusions 68.

The covering 10 carries means for providing visual information regarding orientation of the kite which can comprise a non-symmetical design or picture of an aircraft 46 which is illustrated in side view with its nose near to the nose of the kite and with its tail near to the tail end of the kite. It will be appreciated that when the kite is airborne, only the aircraft 46 will be visible, the remainder of the covering 10 being invisible because of its transparency. The picture of the aircraft 46 is omitted from FIG. 2 in the interests of clarity of illustration.

A weight is supported by the framework at a position forward of a midpoint C located halfway between opposite ends of the longitudinal spar, as shown in FIG. 2. In the preferred embodiment, a tubular lead weight 48 (FIG. 2) is located as a slide fit around the spar 16 between the nose 12 and the cross-over point 20. On either side of the weight 48 is an annular, elastic retainer 50, such as a small rubber band, which fits tightly onto the spar 16 and which prevents movement of the weight. The retainers 50 can, however, be moved forcibly to chosen positions along the length of the spar 16 forwardly of the point 20, thereby to establish a chosen position for the weight 48. The center of gravity of the kite can thus be changed depending on the position of the weight 48.

FIG. 1 illustrates the kite in flight with the control handle held vertically by the flyer and with the picture of the aircraft 46 upright. If the flyer tilts his wrist so that the upper end of the handle 42 comes closer to him and the lower end moves away from him (i.e. as illustrated by the arrow 51 in FIG. 1), extra tension will be applied to the upper control line 38. This change in the orientation of the kite pulls the upper side of the kite towards the flyer with a resultant movement of the centre of wind pressure on the covering 10. The redistribution of wind pressure on the covering 10 causes the kite to rise in the air in a climbing movement of the aircraft 46. On the other hand, if the flyer tilts his wrist in the manner indicated by the arrow 52, the aircraft 46 will go into a dive as the kite drops.

With other movements of the flyer's wrist, the kite can be caused to describe a great number of the maneuvers. Markings "UP" and "DOWN" at the upper and lower ends of the handle 42 may serve a useful function in enabling the flyer to determine the way in which the kite will move in response to a particular wrist movement. If, for instance, the kite is flying in such a manner that the aircraft 46 is in an inverted position i.e. upside-down, the above-described rising movement will result in the kite descending because extra tension is now being applied to the lower of the two control lines 38 which are twisted at some position between the kite and the flyer. In other words, by seeing which way the aircraft is oriented, the flyer knows which way the kite will move when an "UP" or "DOWN" movement of the wrist is used, "UP" or "DOWN" in all cases being a movement of the kite from the viewpoint of an imaginary pilot in the aircraft. To a certain extent, the flying of the illustrated kite, with an aircraft visible in side view, can be likened to the flying of a conventional control-line model aircraft.

From what has been said above, it will be appreciated that small wrist movements only are required to achieve substantial movement of the kite in the air. This is a distinct advantage when compared to prior control line kites where the control bar was a sizeable element held in both hands and required substantial movement of the flyer's arms and body to achieve kite steering, or where control was achieved with the use of two separate handles, one for each control line.

The sensitivity of the kite of the present invention can be attributed to the provision of the weight 48, which controls the balance and stability of the kite since the center of gravity of the kite can be moved towards or away from the center of wind pressure. The effect of the weight is to increase any turning moments applied to the kite during steering activity, thereby ensuring a rapid steering response.

By moving the weight 48 in the manner described above, the flying characteristics of the kite can be changed quite dramatically. With the weight near to the nose of the kite such that the center of gravity of the kite is forward of the center of wind pressure, the kite is able to fly stably even in the absence of a conventional trailing tail as is found in all conventional control line kites known to the inventor. As the weight is moved away from the nose towards the point 20 such that the center of gravity is closer to the center of wind pressure, the stability of the kite is reduced progressively. A kite of the invention whose weight is well away from the nose and close to the point 20 will be extremely sensitive to air movements and steering actions from the flyer, to the extent that in a strong wind the kite may be seen to "twitch" in the air as it flies.

For smoother maneuvering, the flyer will usually set the weight towards the nose so that smooth steering is achieved. For increased pleasure he may prefer to have the weight further back so that the movements of the kite in the air are more difficult to control and necessitate greater skill on the flyer's behalf. In light or constant winds, the flyer would usually prefer the weight further forward, while in heavy or variable winds his flying skill can be tested to a greater degree by having the weight further back. In either case, the center of gravity of the kite is forward of the center of wind pressure The range of permissible movement of the weight ensures that the kite can be set up for the individual preferences of each flyer and for different wind conditions.

Kites of the invention may also be used for aerobatic competition or for fighting. A fighting kite may be fitted with a streamer-type trailing tail and with one or more cutting edges on the covering 10, the object of the exercise being to fly the kite with such precision that a cutting edge is caused to sever the tail of an opponent's kite. In this kind of application, it should be noted that the tail is not provided to increase the drag forces on the kite and hence stabilise it in flight, as is the usual object of a tail, but merely to provide a target to be attacked by the opposing flyer.

Figure 4:
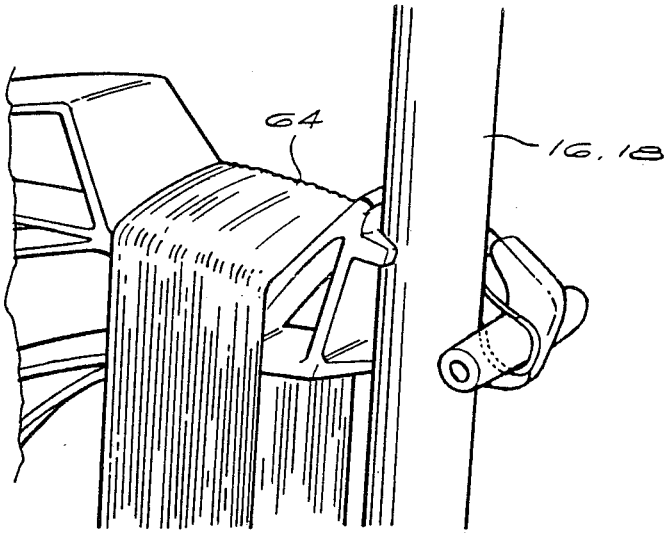
FIG. 4 shows another partial perspective view of an end of the control handle.

The fact that the spars 16 and 18 are hinged to one another, combined with the fact that the pockets 24 can readily be opened to free the spars, enables the kite to be packed and transported with ease when not in use. With the spars removed from the covering 10, they can be clipped to the control handle 42 by lodging each of them against the handle and between the protrusions 68 and the finger 66 at each end of the handle. This is illustrated in FIG. 4 from which it will be appreciated that, with the spars clipped in position, they may be carried along with the handle. The covering 10 can merely be rolled or folded up.

It may happen during flying that one of the control lines 38 is longer than the other one. Bearing in mind that it will be most convenient for the flyer, when flying his kite horizontally, to have the control handle 42 perfectly vertical, it is necessary for him to equalise the lengths of the control lines. In the present embodiment, this is achieved by twisting the longer line a required number of times about the peg 60 at the relevant end of the handle. The twists are formed beneath the finger 66, which is pushed away from the peg 60 out of the way during twisting. The finger 66 springs back to its original position towards the peg 60 to prevent the newly formed twists from slipping off the control handle. This simple twisting operation can be carried out while the kite is in flight.

While the present invention has been described with reference to the foregoing embodiments, various changes and modifications may be made thereto which fall within the scope of the appended claims.

I claim:

1. A control line kite which comprises a generally diamond-shaped covering over a framework of spars including a longitudinal spar extending forwardly from a tail end of the kite to a nose of the kite and a transverse spar crossing the longitudinal spar at a point of intersection, the covering being acted on by wind pressure when the kite is flown such that a center of wind pressure acting on the covering is shifted depending on the orientation of the kite, the kite being tailless and have a truncated tail end, a pair of control lines connected to the kite by bridles for controlling orientation of the kite and a control handle to which the control lines are connected at spaced-apart locations, wherein weighting means are adjustably positioned on the framework forwardly of a midpoint located halfway between opposite ends of the longitudinal spar such that a center of gravity of the kite is located closer to the nose of the kite than is the center of wind pressure acting on the kite when the kite is flown, with the result that the kite enjoys a high degree of maneuverability in flight.

2. A control line kite according to claim 1 wherein the flexible covering is of a transparent material and carries a picture thereon.

3. A control line kite according to claim 2 wherein the picture is that of an aircraft seen from the side, the nose of the aircraft being towards the nose of the kite and the tail of the aircraft being towards the tail end of the kite.

4. A control line kite according to claim 1 wherein the ends of the longitudinal and transverse spars are located in pockets provided at the corners of the diamond-shaped covering.

5. A control line kite according to claim 4 wherein the pockets are formed by folding and securing together mating parts of plastics members fixed to the covering at the corners thereof.

6. A control line kite according to claim 5 wherein the mating parts of the plastics members are folded together about hinge lines and are secured together by press-stud connectors.

7. A control line kite according to claim 1 wherein the control handle can be gripped and controlled, to control manoeuvres of the kite while flying, in one hand of the flyer.

8. A control line kite according to claim 7 wherein the control handle includes recesses for storing the control lines in a wound up condition when the kite is not in use.

9. A control line kite according to claim 7 wherein the control handle includes projecting pegs about which the control lines can be wound to adjust their lengths and means for preventing the control lines from slipping off the pegs.

10. A control line kite which comprises a generally diamond-shaped covering over a framework of spars including a longitudinal spar extending forwardly from a tail end of the kite to a nose of the kite and a transverse spar crossing the longitudinal spar at a cross-over point, the covering being acted on by wind pressure when the kite is flown such that a center of wind pressure acting on the covering is shifted depending on the orientation of the kite, control line means connected to the kite for controlling orientation of the kite and control handle means to which the control line means is connected, wherein weighting means are positioned on the framework forwardly of a midpoint located halfway between opposite ends of the longitudinal spar such that a center of gravity of the kite is located closer to the nose of the kite than is the center of wind pressure acting on the kite when the kite is flown, with the result that the kite enjoys a high degree of maneuverability in flight.

11. The kite of claim 10, wherein the control line means comprises a pair of control lines, each of which is connected to the kite by a bridle and the control handle means comprises a control handle to which the control lines are connected at spaced-apart locations.

12. The kite of claim 11, wherein each of the bridles includes two parts, one of the parts being connected to a respective side corner of the kite and the other of the parts being connected to the tail end of the kite.

13. The kite of claim 10, further comprising means for joining the longitudinal spar to the transverse spar, the joining means comprising a flexible band joining the longitudinal spar to the transverse spar at the cross-over point.

14. The kite of claim 10, further including retainer means for retaining the weighting means at a selected position on the longitudinal spar.

15. The kite of claim 14, wherein the weighting means comprises a weight movably supported on the longitudinal spar and the retainer means comprises at least one retainer flexible in any one of a plurality of positions along the longitudinal spar so as to prevent movement of the weight.

16. The kite of claim 10, further comprising pocket means for supporting free ends of the longitudinal spar and free ends of the transverse spar, the pocket means comprising a plurality of plastic members, each of the plastic members including mating parts foldable about a hinge line to cover a respective one of the free ends and including separable connectors for securing the mating parts together.

17. The kite of claim 10, wherein the covering is transparent and includes means thereon for providing visual information regarding orientation of the kite, the visual information providing means comprises a picture of an aircraft with a nose of the aircraft facing the nose of the kite and a tail of the aircraft facing a tail end of the kite.

18. The kite of claim 10, wherein the tail end of the kite is truncated in shape.

* * * * *